US007503554B2

(12) United States Patent
Trovinger et al.

(10) Patent No.: US 7,503,554 B2
(45) Date of Patent: Mar. 17, 2009

(54) BOOK FINISHING STATION WITH HEATING ELEMENT AND METHOD OF USE

(75) Inventors: Steven W. Trovinger, Los Altos, CA (US); Ross R. Allen, St. Helena, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 259 days.

(21) Appl. No.: 11/290,043

(22) Filed: Nov. 30, 2005

(65) Prior Publication Data

US 2007/0120312 A1 May 31, 2007

(51) Int. Cl.
*B65H 37/04* (2006.01)

(52) U.S. Cl. ..... 270/52.26; 270/52.18; 270/52.3; 270/58.07; 270/58.08

(58) Field of Classification Search ..... 270/52.18, 270/52.26, 52.3, 58.07, 58.08; 412/41
See application file for complete search history.

(56) References Cited

U.S. PATENT DOCUMENTS 2,640,208 A * 6/1953 De Florez et al. ..... 412/8
4,041,883 A * 8/1977 Meratti ..... 112/21
4,100,639 A * 7/1978 Dietrich ..... 412/1
4,156,538 A * 5/1979 Roberts ..... 281/29
5,868,539 A * 2/1999 Rathert ..... 412/5
6,000,894 A * 12/1999 Suzuki et al. ..... 412/11
6,099,225 A 8/2000 Allen et al.
6,550,756 B2 4/2003 Trovinger
6,619,900 B2 * 9/2003 Cobene et al. ..... 412/1
6,673,002 B2 1/2004 Trovinger et al.
6,682,285 B2 1/2004 Trovinger et al.
6,708,967 B1 3/2004 Trovinger et al.
6,715,749 B2 4/2004 Trovinger
6,726,423 B2 * 4/2004 Hocking ..... 412/1
6,796,554 B2 9/2004 Trovinger
6,808,479 B2 10/2004 Trovinger et al.
6,834,853 B2 12/2004 Trovinger et al.
6,837,841 B2 1/2005 Trovinger
6,855,101 B2 2/2005 Trovinger et al.
2002/0168247 A1 11/2002 Trovinger et al.
2003/0069118 A1 4/2003 Trovinger et al.
2003/0069119 A1 4/2003 Trovinger et al.
2003/0069121 A1 4/2003 Trovinger et al.
2003/0161704 A1 8/2003 Trovinger
2003/0161705 A1 8/2003 Trovinger
2004/0041326 A1 3/2004 Trovinger
2004/0048728 A1 3/2004 Trovinger et al.
2004/0052613 A1 3/2004 Trovinger (Continued)

FOREIGN PATENT DOCUMENTS

EP 0992 365 A1 4/2000

(Continued)

*Primary Examiner*—Gene Crawford
*Assistant Examiner*—Leslie A Nicholson, III

(57) ABSTRACT

A book finishing station configured to process a media sheet includes a support apparatus, a clamping apparatus, and a heating element. The clamping apparatus is spaced from the support apparatus. During use, a media sheet is positioned between the support apparatus and the clamping apparatus, and the clamping apparatus is configured to move toward the support apparatus to clamp the media sheet between the support apparatus and the clamping apparatus. The heating element is coupled with one of the support apparatus and the clamping apparatus and is configured to apply heat to the media sheet near a fold line defined by the media sheet.

30 Claims, 7 Drawing Sheets

U.S. PATENT DOCUMENTS

| | | | |
|---|---|---|---|
| 2004/0063560 | A1 | 4/2004 | Trovinger |
| 2004/0089999 | A1 | 5/2004 | Trovinger et al. |
| 2004/0092377 | A1 | 5/2004 | Trovinger |
| 2004/0094884 | A1 | 5/2004 | Trovinger et al. |
| 2004/0094891 | A1 | 5/2004 | Trovinger et al. |
| 2004/0175255 | A1 | 9/2004 | Trovinger et al. |
| 2004/0188910 | A1 | 9/2004 | Trovinger et al. |
| 2004/0239027 | A1 | 12/2004 | Trovinger et al. |
| 2005/0056986 | A9 | 3/2005 | Trovinger et al. |

FOREIGN PATENT DOCUMENTS

| | | |
|---|---|---|
| WO | WO 00/18583 | 4/2000 |

* cited by examiner

BOOK FINISHING STATION WITH HEATING ELEMENT AND METHOD OF USE

BACKGROUND

Electronic document publishing often demands more than a stack of paper in an output tray of an office printer. Typically, a plurality of duplex printed sheets are bound into finished documents by a publishing system that prints and finishes books. Publishing systems perform operations such as collating, binding, folding, trimming, stapling, etc. These finishing operations are typically performed on all of the sheets in a book at one time, which generally requires the use of high forces and powerful motors. Consequently, the systems adapted to perform these functions are relatively expensive and often exceed the cost of other desktop or office printers. As such, known publishing systems are not generally well suited for use in low-cost desktop bookmaking.

In order to lower the cost of publishing systems, the forces within the publishing system are typically decreased or minimized. Accordingly, sheet-wise folding systems have developed in which individual sheets are folded and subsequently accumulated rather than folding the entire stack of sheets at one time. However, booklets folded by conventional low-force publishing systems oftentimes do not exhibit crisp fold lines, which contributes to the creation of undesirable pillowing or puckering of the booklet sheets around the spine of the booklet. Since pillowing is generally indicative of a low-quality booklet, a publishing system is desired that includes a folding apparatus that utilizes low magnitude forces and while also decreasing pillowing the bound documents output from the publishing system.

SUMMARY

One aspect of the present invention relates to a book finishing station configured to process a media sheet. The book finishing station includes a support apparatus, a clamping apparatus, and a heating element. The clamping apparatus is spaced from the support apparatus. During use, a media sheet is positioned between the support apparatus and the clamping apparatus, and the support apparatus is configured to move toward the clamping apparatus to clamp the media sheet between the support apparatus and the clamping apparatus. The heating element is coupled with one of the support apparatus and the clamping apparatus and is configured to apply heat to the media sheet near a fold line defined by the media sheet.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "down," "over," "above," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
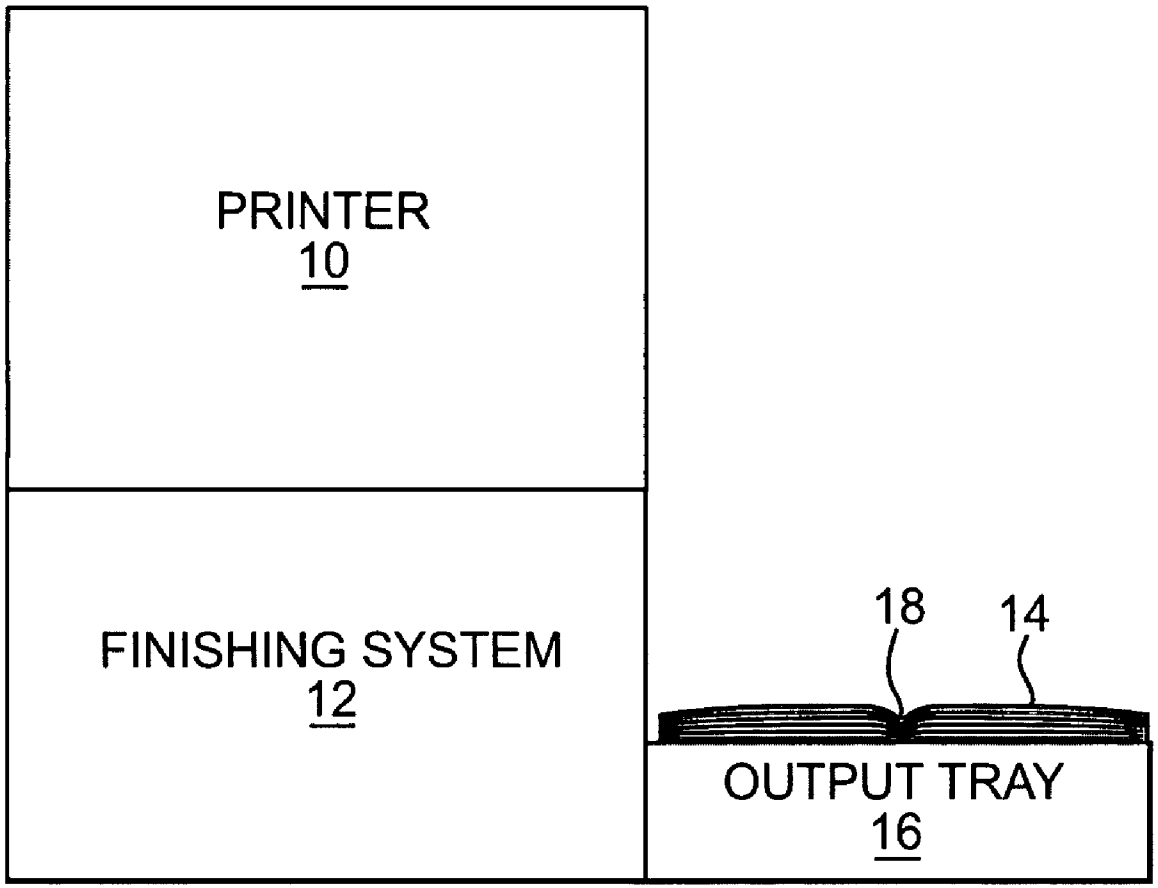
FIG. 1 is block diagram illustrating one embodiment of a printer and a finishing system suitable for use in forming bound documents.

FIG. 1 is a block diagram illustrating one embodiment of a printer 10 and a finishing system 12 suitable for use in forming bound documents or booklets as part of a low-cost system configured to produce finished documents in the electronic publishing environment. In one embodiment, printer 10 prints a plurality of sheets which are fed to finishing system 12 for folding, collating, binding, and performing other finishing operations, if any. Finishing system 12 outputs bound document 14 to an output tray 16 where bound document 14 is accessible by a user.

In one embodiment, finishing system 12 includes at least one finishing station configured to decrease pillowing in bound document 14 by applying heat at and/or near a fold line of individual ones or more than one of the sheets within bound document 14. In one embodiment, heat is provided at and/or near the fold line when the fold line is initially formed in each sheet. In one embodiment, heat is provided over the fold line of each sheet as it is accumulated on a stack of sheets supported over a saddle for further finishing.

The application of heat at and/or near the fold line produces an improved or more crisp fold line, which subsequently decreases pillowing in the final bound document 14. More specifically, heating the sheet generally serves to reduce rigidity of paper polymer fibers that comprise the sheet. The decreased fiber rigidity allows the sheet to be more easily manipulated or formed, in this case, folded or smoothed over other sheets. Accordingly, in one embodiment, when the sheet fibers are heated the fold line can be more crisply defined and/or the sheet can be more smoothly formed over other sheets in a sheet stack. When the fold of the sheet and/or the extension of the sheet on the sheet stack are improved, the amount of pillowing in the associated bound document being formed is decreased accordingly.

In one embodiment, the moisture content of the sheet may also be altered to increase the quality of the fold under generally lower forces. In one embodiment, the sheet may be a least partially wet prior to folding to encourage formation of more crisp fold line. In one embodiment, heating and or wetting the sheets being folded also allows thicker or coated sheets to be more easily foldable, which thereby, decreases the forces generally required to fold such sheets.

Figure 2:
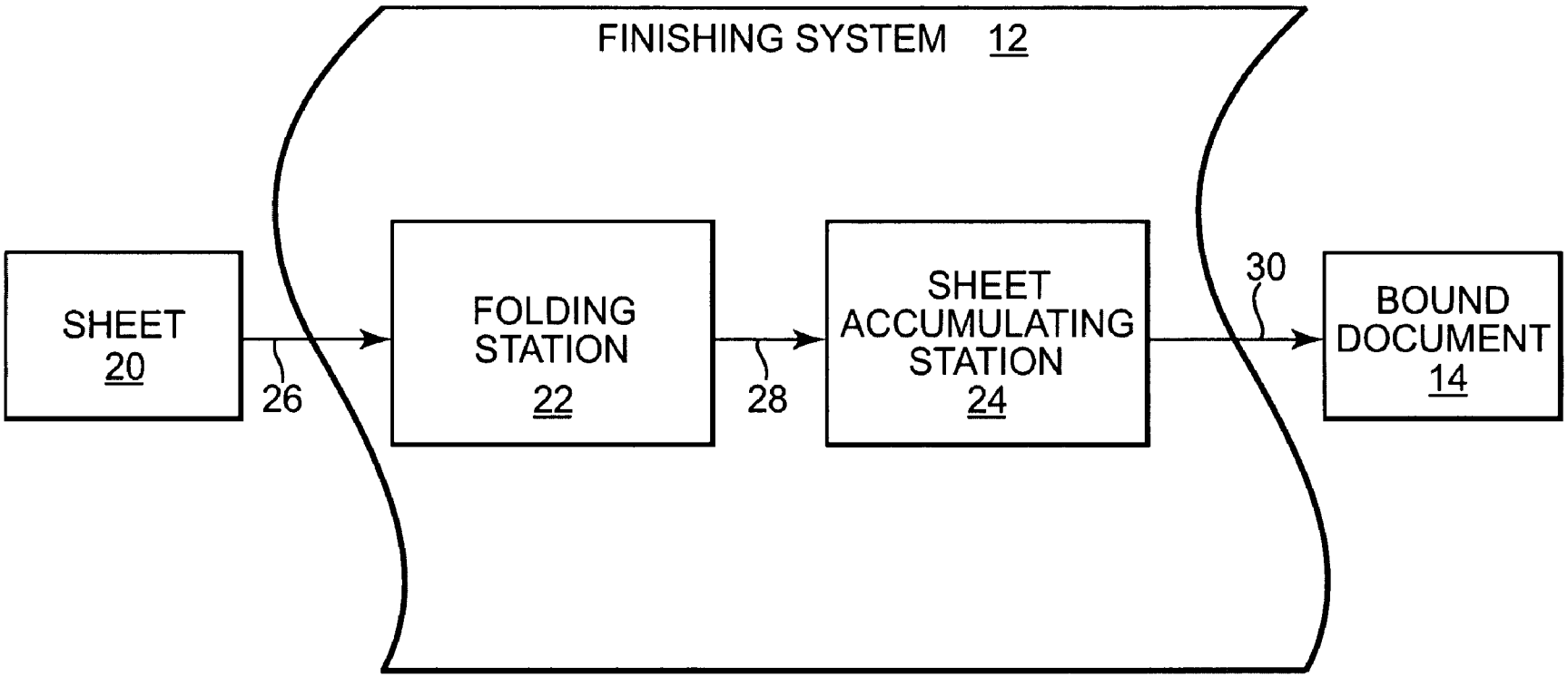
FIG. 2 is a schematic diagram illustrating one embodiment of a portion of the finishing system of FIG. 1 and a sheet path therethrough.

FIG. 2 is a schematic diagram illustrating one embodiment of a path of a print media sheet 20 through at least a portion of finishing system 12. In one embodiment, finishing system 12 includes a plurality of finishing stations, such as, for example, a first finishing station 22 and a second finishing station 24. In one embodiment, first finishing station 22 is folding station configured to fold individual ones or more than one of sheets 20, and second finishing station 24 is sheet accumulating station configured to accumulate and bind the sheets 20 to form bound document 14.

During use and as indicated by arrow 26, one or more sheets 20 are received from printer 10 (illustrated in FIG. 1) or another finishing station within finishing system 12 and fed to folding station 22. After being processed at folding station 22 and as generally indicated by arrow 28, each sheet 20 continues along the sheet path to sheet accumulating station 24. In one embodiment, a plurality of sheets 20 are accumulated and bound or otherwise processed at second station 24. As indicated by exit arrow 30, the plurality of sheets 20 exit sheet accumulating station 22 as bound document 14. In one embodiment, bound document 14 is fed from sheet accumulating station 22 to another finishing station, such as a trimming station, or to output tray 16 (illustrated in FIG. 1).

Figure 3A:
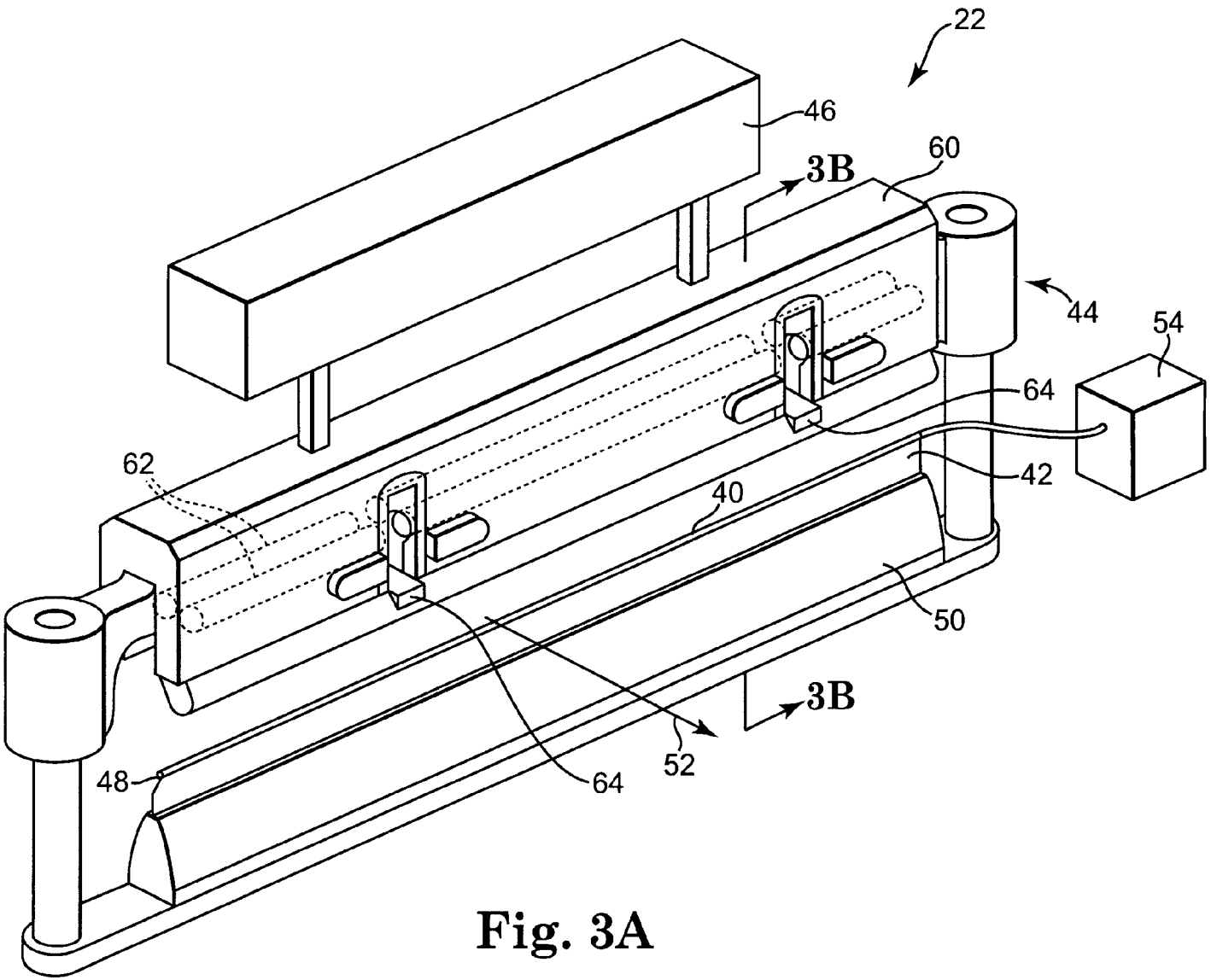
FIG. 3A is a perspective illustration of one embodiment of a folding apparatus of the finishing system of FIG. 2.
Figure 3B:
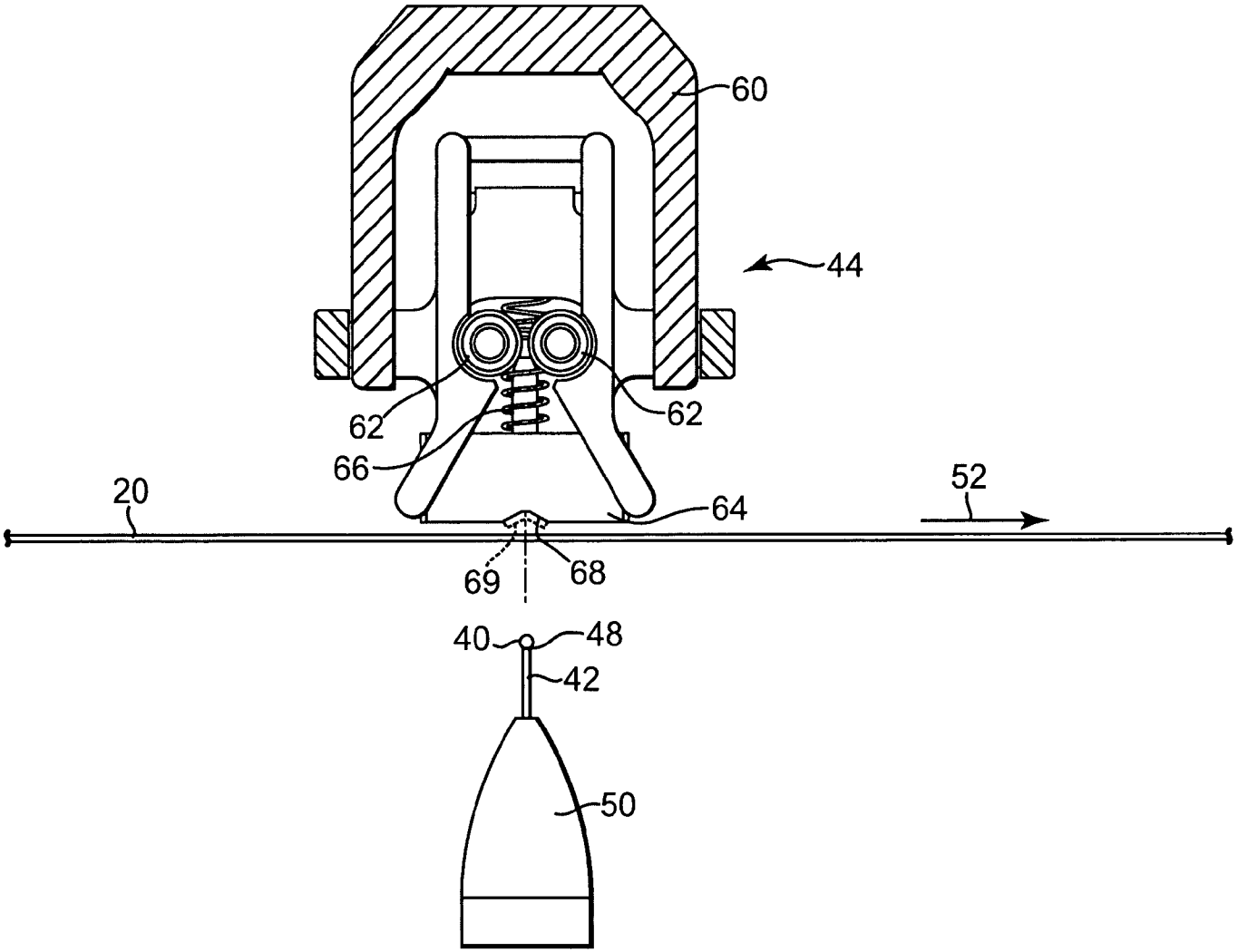
FIG. 3B is a cross-sectional illustration of FIG. 3A taken along the line 3B-3B and including a media sheet.

FIGS. 3A and 3B collectively illustrate one embodiment of folding station 22. Folding station 22 is configured to fold sheets 20 to define spine 18. In particular, in one embodiment, folding station 22 is substantially similar to the sheet folding apparatus disclosed in U.S. Pat. No. 6,855,101 to Trovinger et al., which is hereby incorporated by reference in its entirety, with the addition of a heating element 40 as will be further described below.

In one embodiment, folding station 22 includes a heating element 40, a fold blade 42, a carriage assembly 44, and a drive mechanism 46. Drive mechanism 46 is configured to move carriage assembly 44 toward fold blade 42 to fold one or more sheets 20 (illustrated in FIG. 3B) positioned between fold blade 42 and carriage assembly 44.

In one embodiment, fold blade 42 is made of metal or any other suitable material and is shaped as a substantially flat strip having a generally rectangular cross-sectional profile at its free edge 48. In other embodiments, fold blade 42 is formed having other cross-sectional profiles, such as a rounded, triangular, concave, or convex cross-sectional profile, at free edge 48. In one embodiment, fold blade 42 is supported by a blade holder 50 and laterally extends in a direction substantially perpendicular to the sheet path, which is generally indicated in FIGS. 3A and 3B by arrow 52. In one embodiment, fold blade 42 is alternatively held by any other stabilizing structure or is manufactured with blade holder 50 as a unitary component.

In one embodiment, heating element 40 extends over free edge 48 of fold blade 42. Heating element 40 is a strip heater, a wire heater, or any other heating element suitable for providing heat to sheet(s) 20 passing through folding station 22. In one embodiment, heating element 40 is coupled to a heat or electricity source 54. In one embodiment, heating element 40 is configured to heat sheet 20 to relax the fibers of each sheet 20, thereby, permitting a sharper and more crisp fold line to be produced and pressed into each sheet 20. In one embodiment, each sheet 20 is heated to a temperature between about 150° C. and about 200° C. In one embodiment, the temperature at which sheet 20 is heated is selected to be sufficiently low to avoid reflowing toner or ink previously printed to sheets 20. In one embodiment, sheet 20 is heated to a glass transition temperature ($T_g$) of polymeric fiber components within the sheet, if any. The glass transition temperature is generally a temperature at which a polymeric material transitions from a hard and brittle state to a state allowing for plastic deformation of the polymeric material. In other embodiments, sheet 20 is heated to a temperature below or above the glass transition temperature of any polymeric fiber components within sheet 20.

Carriage assembly 44 extends substantially parallel to and above fold blade 42. Carriage assembly 44 is coupled with drive mechanism 46. Drive mechanism 46 is configured to selectively move carriage assembly 44 toward fold blade 42. In another embodiment, carriage assembly 44 is substantially stationary and fold blade 42 alternatively moves toward carriage assembly 44.

In one embodiment, carriage assembly 44 includes a housing 60, fold rollers 62, and one or more pinch foot 64. Housing 60 is configured to retain fold rollers 62 and at least one pinch foot 64 and is coupled with drive mechanism 46. In one embodiment, housing 60 extends parallel to fold blade 42 and is made of any suitable material, such as metal or plastic.

Fold rollers 62 are rotatably attached to an interior portion of housing 60. Two fold rollers 62 are included in the embodiment of carriage assembly 44 illustrated in FIGS. 3A and 3B. However, in other embodiments, any number of fold rollers 62 may be utilized. Each fold roller 62 rotates about an axis parallel to the lateral extension of fold blade 42 and is biased toward the opposing fold roller 62. Fold rollers 62 are positioned relative to fold blade 42 such that when moved toward fold blade 42, fold blade 42 is positioned in a plane which passes between fold rollers 62. In one embodiment, fold rollers 62 are heated in addition to heating element 40 to further encourage formation of a quality. fold line. In one embodiment, fold rollers 62 are heated in alternative to heating element 40.

In one embodiment, no fold roller 62 is included within folding station 22. In one embodiment, carriage assembly 44 includes additional or other devices or assemblies for forming sheet 20 around fold blade 42 to form a fold within sheet 20. In one embodiment, no fold roller 62 is included in carriage assembly 44.

Each pinch foot 64 is configured to clamp against fold blade 42, and is resiliently mounted to an internal portion of housing 60. For example, each pinch foot 64 is attached to housing 60 with a pinch spring 66 as illustrated in FIG. 3B. However, use of any other suitable resilient attaching means is also contemplated to attach each pinch foot 64 to housing 60. Each pinch foot 64 is made of any suitable material, such as metal, plastic, etc. In one embodiment, one or more pinch foot 64 is formed of a substantially rigid or non-deformable material. In another embodiment, one or more pinch foot 64 is formed of a deformable or resilient material. In one embodiment, two or more pinch feet 64 are included within housing 60 spaced laterally apart from one another.

As illustrated in FIG. 3B, in one embodiment, each pinch foot 64 defines a pinch groove 68 configured to locate and hold sheet 20 against fold blade 42. In one embodiment, pinch groove 68 has an inverted-V cross-sectional shape. However, in other embodiments, pinch groove 68 is formed with any other suitable cross-section shape configured to correspond with the cross-sectional shape of fold blade 42. In one embodiment, a heating element 69 (illustrated in dashed lines) may additionally or alternatively be included on pinch foot 64 and/or one or more of fold rollers 62.

During use of folding station 22, one or more of sheets 20 enter folding station 22 and are generally jogged and/or aligned in any suitable method to facilitate proper placement of sheet(s) 20 for folding and heating. Once sheet(s) 20 is positioned, drive mechanism 46 moves carriage assembly 44 toward sheet 20 and fold blade 42. As carriage assembly 44 is moved toward fold blade 42, sheet 20 is clamped and secured between fold blade 42 and each pinch foot 64, more particularly, pinch groove 68. In one embodiment, as carriage assembly 44 progresses further toward fold blade 42, each pinch foot 64 is forced back into housing 60 against springs 66, while maintaining pressure on sheet 20 against fold blade 42 due to the action of pinch springs 66. In one embodiment, when sheet 20 is clamped between fold blade 42 and pinch grooves 68, sheet 20 is secured relative to folding station 22 to define a fold position and to ensure proper alignment of sheet 20 relative to fold blade 42.

In one embodiment, a fold line 70 (best seen in FIG. 4) is formed in sheet 20 by moving fold rollers 62 relative to fold blade 42 such that fold blade 42 and sheet 20 pass between fold rollers 62. For example, housing 60 moves toward fold blade 42 such that sheet 20 is deformed between fold blade 42, more particularly, heating element 40, and fold rollers 62 to fold sheet 20. Accordingly, heating element 40 contacts sheet 20 under fold line 70. In other embodiments, folding station 22 is configured to additionally or alternatively apply heat over fold line 70. In one embodiment, sheet 20 is heated by heating element 40 for less than about one second. In one embodiment, fold rollers 62 are biased toward each other with the use of any springs or other biasing mechanism or material. By heating sheet 20 with heating element 40 while pressing and rolling fold rollers 62 against sheet 20 and fold blade 42, a portion of sheet 20 conforms to the shape of fold blade 42 and thus a crisp fold line 70 is defined in sheet 20.

Upon folding sheet 20, drive mechanism 46 or other biasing force moves carriage assembly 44 away from fold blade 42, which also moves pinch foot 64 and fold rollers 62 away from fold blade 42. Although described above as moving carriage assembly 44 relative to the generally stationary fold blade 42, in other embodiments, carriage assembly 44 is substantially stationary, drive mechanism 46 is coupled to fold blade 42, and fold blade 42 is moved relative to carriage assembly 44. Other such alterations or additions to the folding station 22 described above are also contemplated.

Although described above as folding each sheet 20 in a sheet-wise manner (i.e. one sheet 20 is folded at a time), in other embodiments, any number of the plurality of sheets 20 are punched and folded at one time. In one embodiment, the number of the plurality of sheets 20 folded at one time includes more than one and less than all of sheets 20. In this respect, although the forces used to fold more than one sheet 20 are generally greater than the forces used to fold a single sheet 20, the forces are still generally smaller than conventional forces used to fold all of sheets 20 in a single operation. In one embodiment that folds a portion of sheets 20 including more than one sheet 20 at one time, the heat applied to sheets 20 may only impact one of the portion of sheets 20 (i.e., the sheet nearest fold blade 42). However, application of heat to one or more of sheets 20 still serves to increase the crispness of fold line 70 and, therefore, of spine 18 (illustrated in FIG. 1) of bound document 14.

Figure 4:
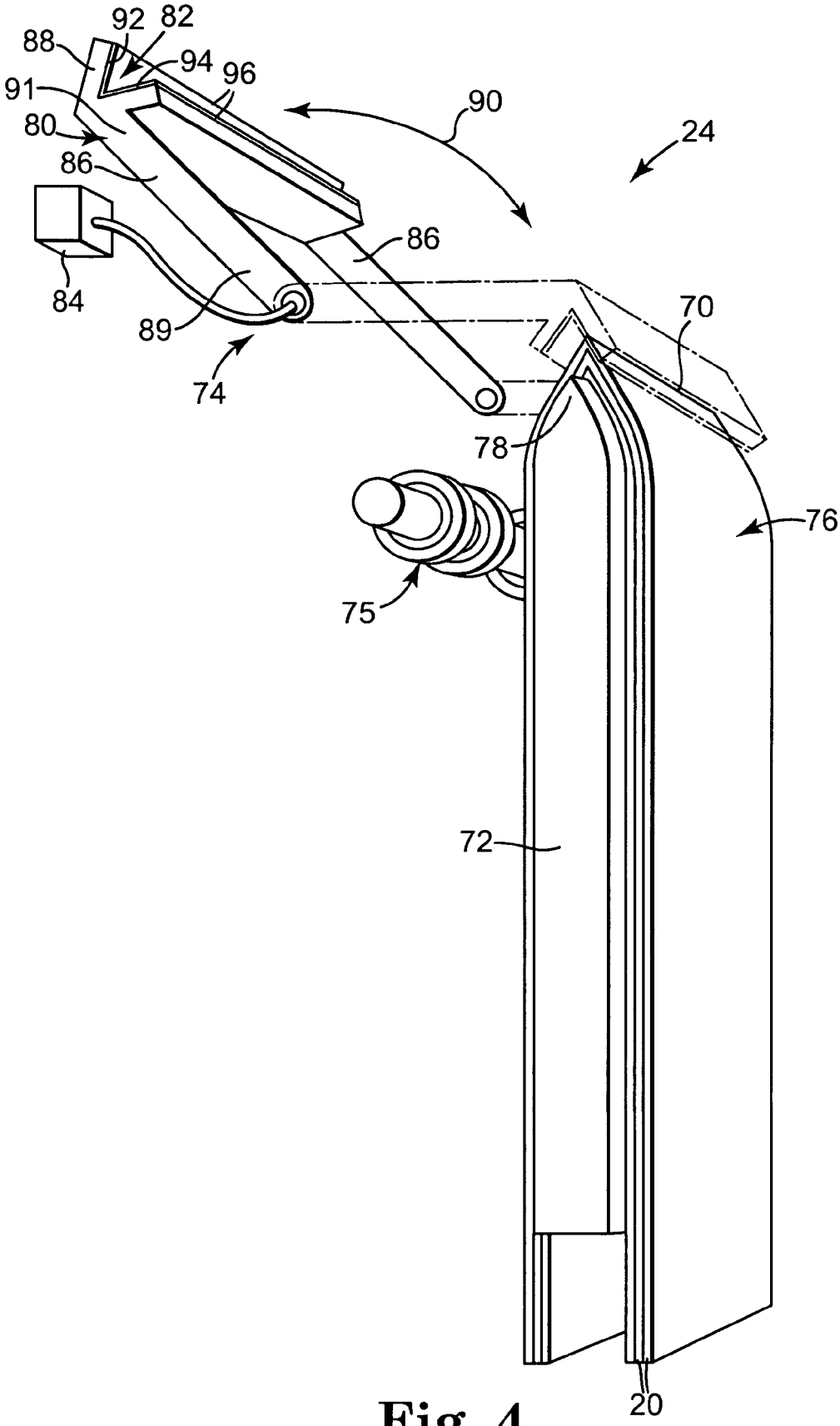
FIG. 4 is a perspective illustration of one embodiment of a folding apparatus of the finishing system of FIG. 2.

As generally illustrated in FIG. 2, in one embodiment, following folding of sheet(s) 20, sheet(s) 20 are forwarded from folding station 22 to sheet accumulating station 24 for further finishing operations. For example, FIG. 4 illustrates one embodiment of a sheet accumulating station 24 configured to accumulate and bind sheets 20 and including a saddle or other sheet support 72 and a supplemental heating apparatus 74. Saddle 72 is configured to receive each of the plurality of sheets 20 from folding station 22 (illustrated in FIG. 2) to form a sheet stack 76. The plurality of sheets 20 are positioned on saddle 72 in a jogged or aligned manner such that one or more edges and/or fold lines 70 of sheets 20 align with one another. In one embodiment, saddle 72 includes a pointed end 78 such that fold lines 70 of sheets 20 are positioned over pointed end 78 and sheet 20 is maintained on saddle 72 in a partially folded configuration. In one embodiment, sheets 20 are collected on saddle 72 with the use of a rotating collection drive 75 positioned near saddle 72.

Supplemental heating apparatus 74 includes a support assembly 80, a heating element 82, and a drive mechanism 84. Support assembly 80 supports heating element 82, and drive mechanism 84 is any suitable mechanism configured to drive movement of support assembly 80 toward and away from sheets 20 accumulated on saddle 72. In one embodiment, support assembly 80 includes at least one arm 86 and a heating platform 88 that supports heating element 82. Each arm 86 is an elongated member having a first end 89 rotatably mounted to a substantially stationary frame or other member (not illustrated for clarity) within finishing system 12. Accordingly, each arm 86 is configured to rotate about the connection between arm 86 and finishing system 12 as generally indicate by arrow 90.

Heating platform 88 is secured to and extends from a second end 91 of arm 86 opposite first end 89. In one embodiment in which supplemental heating apparatus 74 includes two arms 86 spaced from one another, heating platform 88 extends between second ends 91 of the two arms 86. In one embodiment, heating platform 88 is formed in a substantially V-shape to form two planar surfaces 92 and 94 angularly positioned relative to one another to correspond with a angular geometry of saddle 72. In particular, the V-shape of heating platform 88 is configured to fit over pointed end 78 of saddle 72 and to press against any sheets 20 accumulated thereon.

Heating element 82 is any suitable element configured to provide heat to sheets 20 as will be further described below. In one embodiment, heating element 82 includes one or more pad or strip heaters 96 secured to or embedded within planar surfaces 92 and 94. In one embodiment, heating element 82 is configured to heat sheet 20 to relax the fibers of each sheet 20, thereby, facilitating formation of a more crisp fold line 70 and/or formation or smoothing of sheet 20 over other sheets 20 in sheet stack 76. In one embodiment, saddle 72 is additionally continuously or periodically heated to facilitate formation of a crisp fold line 70 in the one or more of the first sheets 20 placed on saddle 72.

In one embodiment, each sheet 20 is heated to a temperature between about 150° C. and about 200° C. In one embodiment, the temperature at which sheet 20 is heated is selected to be sufficiently low to avoid reflowing the toner or ink previously printed to sheets 20. In one embodiment, heating element 82 heats sheet 20 to a glass transition temperature ($T_g$) of polymeric fiber components within sheet 20, if any. In other embodiments, heating element 82 heats sheet 20 to a temperature below or above the glass transition temperature of any polymeric fiber components of sheet 20. Although described above as including a heating element 40 and 82 on each of folding station 22 and sheet accumulating station 24, in one embodiment, a heating element 40 or 82 is only included in one of folding station 22 and sheet accumulating station 24.

As each sheet 20 is added to sheet stack 76 on saddle 72, supplemental heating apparatus 74 rotates, as generally indicated by arrow 90, or otherwise moves about the connection with a finishing system frame to move heating platform 88, and therefore, heating element 82 towards pointed end 78 of saddle 72. In particular, heated element 82 is moved to contact the one sheet 20 most recently disposed on saddle 72 (i.e., the outermost sheet 20). Heating element 82 applies heat to outermost sheet 20 relaxing the sheet fibers to improve fold line 70 and to smooth and form sheet 20 over any sheets 20 previously accumulated on saddle 72. In one embodiment, supplemental heating apparatus 74 is also configured to apply heat to sheets 20 with a desired pressure to further encourage formation of a well-defined fold line 70 configured to decrease pillowing of the final bound document 14.

Once heat has been applied to sheet 20 for a desired time, arm 86 rotates in the opposite direction to return to a position away from saddle 72 such that additional sheets 20 may be accumulated on saddle 72. In one embodiment, heat element 82 applies heat to sheet 20 for less than about one second. Any other suitable heating apparatus configured to move heating element 82 relative to saddle 72 in a rotational or non-rotational manner may be used as an alternative to supplemental heating apparatus 74.

Although primarily described above as applying heat from supplemental heating apparatus 74 to individual ones of sheets 20, in other embodiments, any number of the plurality of sheets 20 to be used in bound document 14 are accumulated between each application of heat from supplemental heating apparatus 74. In one embodiment, a portion of the plurality of sheets 20 including more than one and less than all of sheets 20 are positioned over saddle 72 prior to application of heat to the top sheet 20. In such an embodiment, the heat applied to sheets 20 by supplemental heating apparatus 74 may only impact one of sheets 20 (i.e., the uppermost sheet 20). However, application of heat to one or more of sheets 20 still serves to increase the crispness of fold line 70 and, therefore, of spine 18 (illustrated in FIG. 1) of bound document 14.

In one embodiment, once all sheets 20 have been accumulated on saddle 72 and have been heated and/or pressed by supplemental heating apparatus 74, sheet stack 76 is stapled or otherwise bound together while on saddle 72. More particularly, in one embodiment staplers (not illustrated) contact sheet stack 76 positioned over pointed end 78 to secure staples through sheet stack 76 along fold line 70. As generally indicated by exit arrow 28, once sheets 20 are bound, the plurality of sheets 20 exit sheet accumulating station 24 as bound document 14. In one embodiment, bound document 14 exiting finishing station 24 is forwarded to another finishing station or output tray 16 (illustrated in FIG. 1). In one embodiment, bound document 14 is forwarded form sheet accumulating station 24 to a trimming station. Although described above as being a supplemental heating apparatus, in one embodiment, in which no heating element 40 is included on fold blade 42, heating apparatus 74 is a primary heating apparatus.

Figure 5:
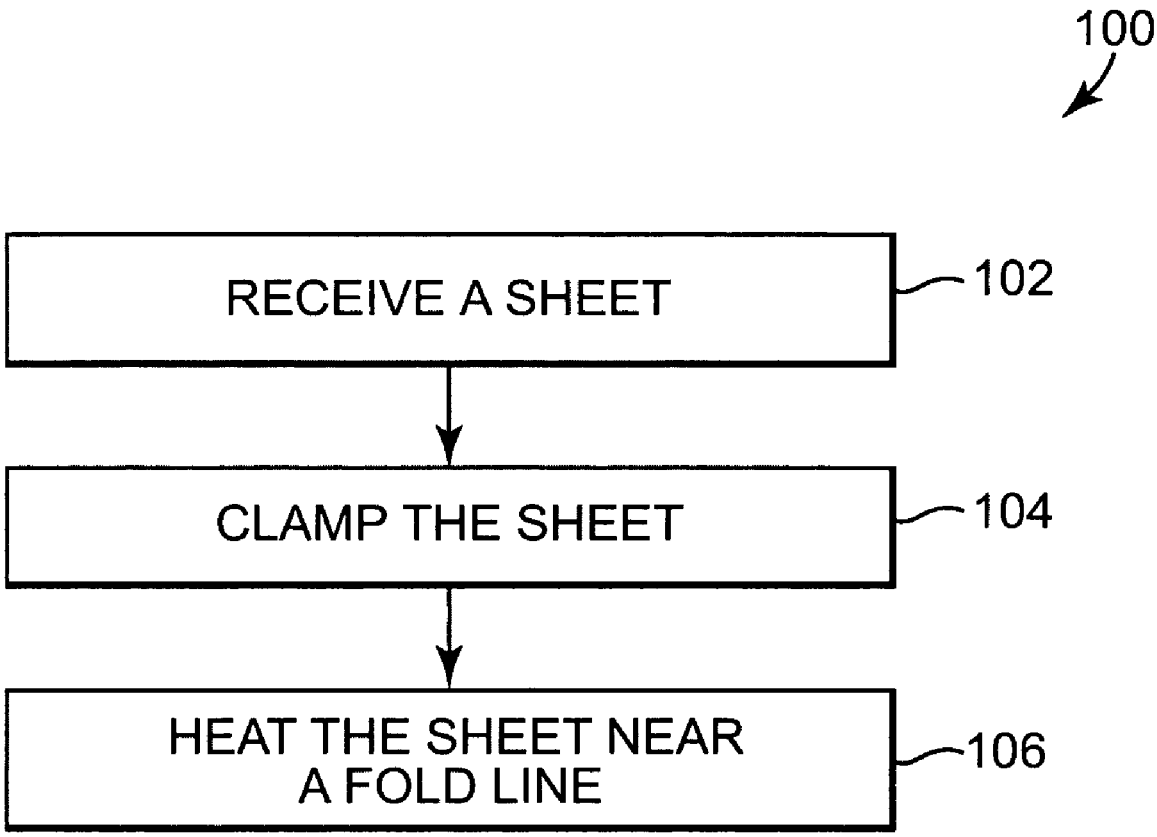
FIG. 5 is a flow chart illustrating one embodiment of a method of finishing sheets for a bound document.

A general method 100 of finishing a bound document 14 is illustrated in FIG. 5. At operation 102, one or more sheets are received on a support apparatus within a finishing station. At operation 104, a clamping apparatus moves toward the support apparatus to clamp the one or more sheets therebetween. At operation 106, the one or more sheet is heated near a fold line formed in the one or more sheets to more crisply define the fold line in the one or more sheets and/or to smooth the one or more sheets near the fold line. In one embodiment, operations 104 and 106 occur substantially concurrently.

In one embodiment, the support apparatus used in method 100 is fold blade 42, the clamping apparatus is carriage assembly 44, and sheet 20 is heated by heating element 40. In another embodiment, the support apparatus used in method 100 is saddle 72, the clamping apparatus is heating apparatus 74, and the sheet is heated by heating element 82. Use of other suitable devices as the support and clamping apparatus of method 100 are also contemplated. Although method 100 is described as finishing one sheet, it should be understood that the one sheet 20 can be finished individually or while aligned with one or more other sheets 20.

Figure 6:
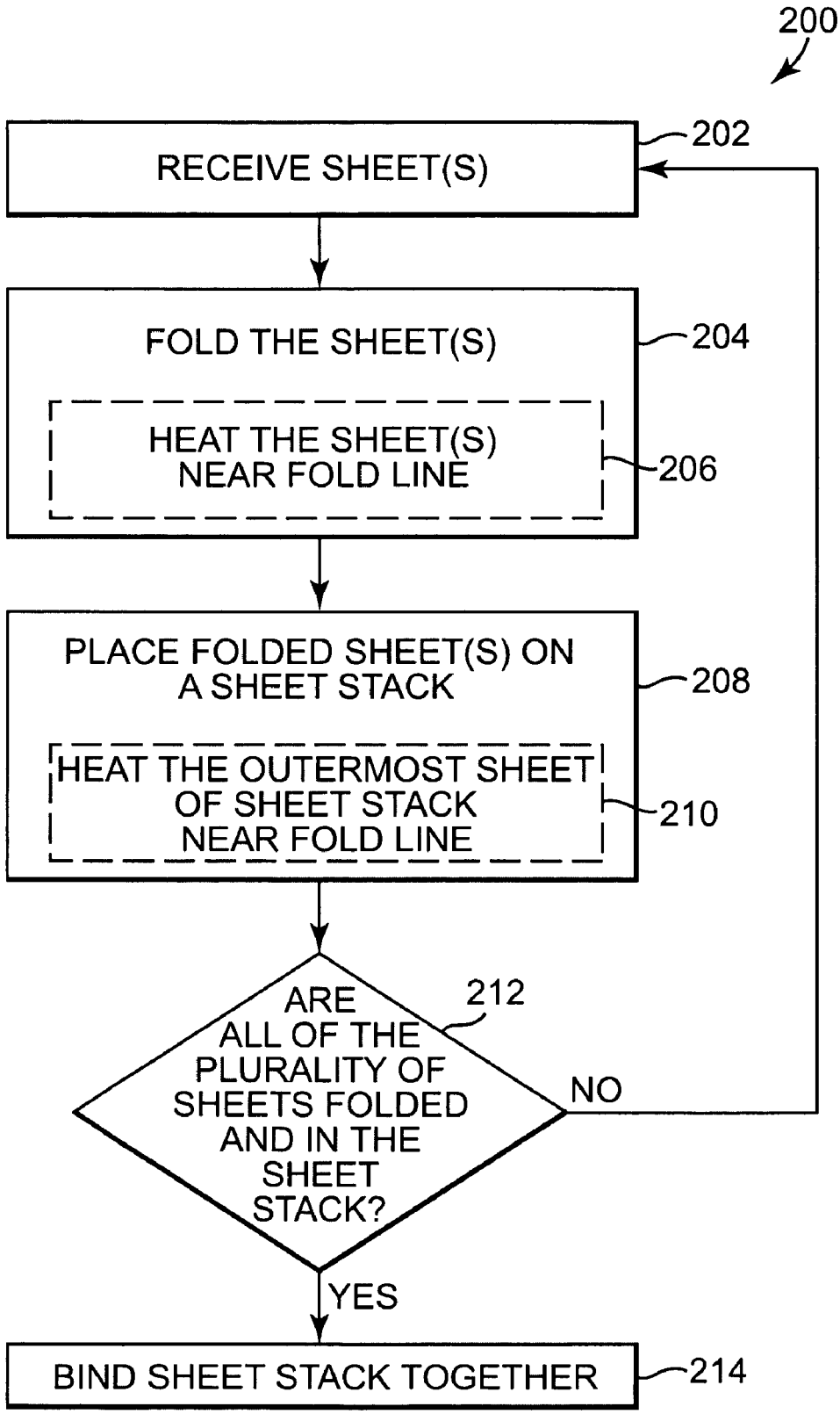
FIG. 6 is a flow chart illustrating one embodiment of a method of finishing sheets for a bound document.

FIG. 6 generally illustrates one embodiment of a method of finishing a bound document at 200 and is described as being performed by finishing station 12 with additional reference to FIGS. 2-4. At operation 202, a portion of sheets 20, which includes an individual sheet 20 or more than one of sheets 20, is received within folding station 22 between fold blade 42 and carriage assembly 44 to fold sheet 20. For ease of description, the portion of sheets 20 is primarily described in method 200 as a single sheet 20 with the understanding that other numbers of sheets 20 could alternatively be used. Sheet 20 is received at folding station 22 and is jogged or aligned in any suitable manner to properly position sheet 20 relative to fold blade 42.

At operation 204, sheet 20 is folded at folding station 22. In particular, drive mechanism 46 drives carriage assembly 44 toward fold blade 42. As carriage assembly 44 moves toward fold blade 42, sheet 20 is pressed against and folded down around fold blade 42 by interaction with pinch foot 64 and fold rollers 62. In one embodiment, as part of operation 204, at operation 206, sheet 20 is heated by heating element 40 to increase the crispness of fold line 70 being formed in sheet 20. In one embodiment where the portion of sheets 20 is greater than one sheet 20, only a few of sheets 20 nearest the heating element 40 are influenced by heating element 40 while the other sheets 20 in the portion of sheets 20 are folded without being heated. In one embodiment, no heating element 40 is included on fold blade 42, and therefore, heat is not applied to sheet 20 during folding at operation 204.

At operation 208, sheet 20 is forwarded to sheet accumulating station 24 and is placed over saddle 72. In one embodiment, sheet 20 is placed over other sheets 20 that have been previously accumulated on saddle 72 to partially form sheet stack 76. As sheets are placed on saddle 72, sheets 20 are jogged or otherwise positioned to align the edges and/or fold lines 70 of each sheet 20 with the edges and/or fold lines of the other sheets 20. In one embodiment, operation 208 includes operation 210 in which after each sheet 20 or portion of sheets 20 is added to saddle 72, supplemental heating apparatus 74 is activated to move heating element 82 into contact with the sheet 20 that is currently positioned outermost on saddle 72.

As heating pads 96 contact outermost sheet 20, outermost sheet 20 is relaxed and formed relatively smoothly over saddle 72 or other sheets 20 positioned between outermost sheet 20 and saddle 72. As such, any puckers or other paper configurations that tend to contribute to pillowing in an end document 14 can be decreased. In one embodiment, method 200 includes heating sheets 20 at both operations 206 and 210. In other embodiments, method 200 includes heating sheets 20 at only one of operations 206 and 210.

Following operation 208, at operation 212 it is determined if all the plurality of sheets 20 to be included in bound document 14 have been folded and accumulated in sheet stack 76. If all sheets 20 have not been folded and accumulated, then operations 202, 204, 208, and 212 are repeated as necessary for another portion of sheets 20 until all sheets 20 have been folded and accumulated into sheet stack 76. In one embodiment, in which multiple portions of sheets 20 are to be included in sheet stack 76, one portion of sheets 20 is received and folded at operations 202 and 204 substantially concurrently with the placement of a different portion of sheets 20 on saddle 72 at operation 208. If, at operation 212, it is determined that all sheets 20 have been folded and accumulated into sheet stack 76 as desired, method 200 continues to operation 214.

At operation 214, sheet stack 76 is bound with staples, adhesive, or other suitable binding device or compound. Once sheet stack 76 is bound, bound document 14 is formed and output to an output tray 16 (illustrated in FIG. 1) or to another finishing station, such as a trimming station, etc.

Although specific embodiments have been illustrated and described herein, it will be appreciated by those of ordinary skill in the art that a variety of alternate and/or equivalent implementations may be substituted for or combined to form variations of the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A book finishing station configured to process a media sheet, comprising:

a sheet path arranged to transport a portion of a plurality of unfolded, unbound media sheets;

a support apparatus oriented generally perpendicular to the paper path and configured to receive the portion of unfolded, unbound media sheets;

a clamping apparatus spaced from the support apparatus, wherein during use, the portion of unfolded, unbound media sheets is positioned along the sheet path between the support apparatus and the clamping apparatus, and the clamping apparatus is configured to move toward the support apparatus to fold the portion of unfolded, unbound media sheets about the support apparatus wherein a clamping action between the support apparatus and the clamping apparatus forms a fold line in the portion of unbound media sheets;

a heating element coupled with one of the support apparatus and the clamping apparatus and being configured to apply heat, during clamping of the portion of unbound media sheets and prior to binding of the portion of folded, unbound media sheets, to the portion of folded, unbound media sheets near the fold line; and a sheet accumulator configured to accumulate the portion of folded, unbound media sheets prior to binding of the portion of folded, unbound media sheets with other folded, unbound media sheets.

2. The book finishing station of claim 1, wherein the heating element is configured to contact the portion of folded, unbound media sheets to apply heat.

3. The book finishing station of claim 2, wherein the heating element is configured to contact the portion of folded, unbound media sheets for less than about one second.

4. The book finishing station of claim 1, wherein the heating element is configured to heat the portion of folded, unbound media sheets to a glass transition temperature of the respective media sheets.

5. The book finishing station of claim 1, wherein the clamping apparatus includes the heating element.

6. The book finishing station of claim 1, wherein the plurality of folded, unbound media sheets is accumulated on the sheet accumulator.

7. The book finishing station of claim 6, wherein the sheet accumulator includes a saddle and a supplemental heating apparatus that includes a second clamping apparatus configured to be moved toward the saddle after each portion of folded, unbound media sheets is accumulated on the saddle to heat and clamp each respective portion of folded, unbound media sheets.

8. The book finishing station of claim 1, wherein the heating element is substantially V-shaped and configured to contact the portion of folded, unbound media sheets on each side of the fold line.

9. The book finishing station of claim 1, wherein the clamping apparatus includes a pinch foot, and the support apparatus includes a fold blade.

10. The book finishing station of claim 1, wherein the sheet accumulator comprises:

a saddle configured to receive the portion of folded, unbound media sheet when the portion of folded, unbound media sheets is released from the clamping action between the clamping apparatus and the support apparatus; and a supplemental heating apparatus configured to heat the portion of folded, unbound media sheets supported by the saddle.

11. The book finishing station of claim 10, wherein the saddle supports a stack of folded unbound media sheets previously received after release from the clamping action between the clamping apparatus and the support apparatus, wherein the sheet accumulator is configured to add the received portion of folded, unbound media sheets onto the stack, and wherein the supplemental heating apparatus is configured to heat the portion of folded, unbound media sheets when the portion of folded, unbound media sheets is positioned on the stack.

12. The book finishing station of claim 11, wherein the supplemental heating apparatus includes a heating element and a rotating frame configured to rotate the heating element toward and away from the saddle.

13. The book finishing station of claim 12, wherein the heating element is substantially V-shaped and is configured to contact the portion of folded, unbound media sheets on each side of the fold line.

14. The method of claim 1 wherein the portion of unfolded, unbound media sheets is limited to a single unfolded, unbound media sheet.

15. The method of claim 1 wherein the portion of unfolded, unbound media sheets includes more than one unfolded, unbound media sheet but less than all of the unfolded, unbound media sheets.

16. A book finishing station, comprising:

means for receiving an unfolded, unbound sheet on a support apparatus;

means for folding the unfolded, unbound sheet, separate and independent of a book, about the support apparatus via a clamping apparatus to form a fold line in the unbound sheet;

means for heating the folded, unbound sheet near the fold line during formation of the fold line, wherein the means for heating is included on at least one of the support apparatus and the clamping apparatus; and means for supplying the folded, unbound sheet to be bound with other folded, unbound sheets in a binding apparatus.

17. The book finishing station of claim 16, wherein the means for supplying comprises:

means for adding the folded, unbound sheet to a stack of previously accumulated folded unbound sheets; and means for heating the folded, unbound sheet near the fold line after the folded unbound sheet is added to the stack.

18. A method of finishing a sheet for inclusion within a bound document, the method comprising:

receiving a portion of a series of unfolded, unbound separate sheets on a first support apparatus;

folding the portion of unfolded, unbound separate sheets via clamping the portion of unfolded, unbound separate sheets about the first support apparatus to form a fold line in the portion of unfolded, unbound separate sheets while heating the portion of folded, unbound separate sheets near the fold line;

accumulating the portion of folded, unbound separate sheets as part of a stack on a second support apparatus; and supplying the stack of folded, unbound separate sheets from the second support apparatus to a binding station for inclusion as part of the bound document.

19. The method of claim 18, wherein heating the portion of folded, unbound separate sheets includes clamping and heating the portion of unbound sheets at substantially the same time.

20. The method of claim 18, wherein heating the portion of folded, unbound separate sheets includes placing the portion of folded, unbound separate sheets in contact with a heating element of the first support apparatus.

21. The method of claim 18, wherein the portion of unbound sheets includes more than one unbound separate sheet and less than all of the unbound, separate sheets of the series to be included in the bound document.

22. The method of claim 18, wherein accumulating the portion of folded, unbound sheets comprises:

placing the portion of folded, unbound sheets over a saddle of the second support apparatus; and heating the portion of folded, unbound sheets near the fold line while the portion of folded, unbound sheets is positioned over the saddle of the second support apparatus.

23. The method of claim 18, wherein the portion of unbound separate sheets is limited to a single unbound, separate sheet.

24. A method of finishing a sheet for inclusion within a bound document, the method comprising:

receiving the at least one sheet in an unfolded configuration on the support apparatus, including jogging the at least one sheet to position the at least one sheet relative to the support apparatus;

folding the at least one sheet via clamping the at least one sheet about the support apparatus to form a fold line in the at least one sheet while heating the at least one folded sheet near the fold line; and supplying the at least one folded sheet to a binding station for inclusion as part of the bound document.

25. A method of finishing a sheet for inclusion within a bound document, the method comprising:

receiving at least one sheet in an unfolded configuration on a first support apparatus;

folding the at least one sheet via clamping the at least one sheet around a fold blade of the first support apparatus to form a fold line in the at least one sheet while heating the at least one folded sheet near the fold line; and supplying the at least one folded sheet from the second support apparatus to a binding station for inclusion as part of the bound document.

26. The method of claim 25, wherein heating the at least one sheet includes coupling a heating element to the fold blade and the heating is performed substantially concurrently with folding of the at least one sheet.

27. A method of finishing a sheet for inclusion within a bound document, the method comprising:

receiving at least one sheet in an unfolded configuration on a first support apparatus;

folding the at least one sheet via clamping the at least one sheet about the support apparatus to form a fold line in the at least one sheet while heating the at least one folded sheet near the fold line;

accumulating the at least one folded sheet on a second support apparatus via;

adding the at least one folded sheet to a stack of folded sheets previously accumulated on the second support apparatus; and heating the respective individual sheets as the respective sheets are added to the stack; and supplying the stack of folded sheets from the second support apparatus to a binding station for inclusion as part of the bound document.

28. A book finishing station configured to process a media sheet, comprising:

a sheet path arranged to transport an unfolded media sheet;

a support apparatus oriented generally perpendicular to the paper path and configured to receive the unfolded media sheet, wherein the support apparatus includes a fold blade;

a clamping apparatus including a pinch foot and spaced from the support apparatus, wherein during use, the unfolded media sheet is positioned along the sheet path between the support apparatus and the clamping apparatus, and the clamping apparatus is configured to move toward the support apparatus to fold the unfolded media sheet about the support apparatus wherein a clamping action between the support apparatus and the clamping apparatus forms a fold line in the media sheet;

a heating element coupled with one of the support apparatus and the clamping apparatus and being configured to apply heat, during clamping of the media sheet and prior to binding of the folded media sheet, to the folded media sheet near the fold line; and a sheet accumulator configured to accumulate the folded media sheet prior to binding of the folded media sheet with other folded media sheets.

29. The book finishing station of claim 28, wherein the pinch foot and the fold blade are configured to form the fold line in the portion of unfolded, unbound media sheets when the portion of unfolded, unbound media sheets is clamped between the support apparatus and the clamping apparatus.

30. The book finishing station of claim 28, wherein the heating element extends across at least a portion of a free edge of the fold blade.

* * * * *

UNITED STATES PATENT AND TRADEMARK OFFICE

CERTIFICATE OF CORRECTION

PATENT NO. : 7,503,554 B2
APPLICATION NO. : 11/290043
DATED : March 17, 2009
INVENTOR(S) : Steven W. Trovinger et al.

It is certified that error appears in the above-identified patent and that said Letters Patent is hereby corrected as shown below:

In column 12, line 12, in Claim 27, delete "via;" and insert -- via: --, therefor.

Signed and Sealed this

Thirtieth Day of March, 2010

David J. Kappos

David J. Kappos
*Director of the United States Patent and Trademark Office*